US006988360B2

(12) United States Patent
Kimura et al.

(10) Patent No.: US 6,988,360 B2
(45) Date of Patent: Jan. 24, 2006

(54) EXHAUST EMISSION PURIFICATION DEVICE FOR INTERNAL COMBUSTION ENGINE

(75) Inventors: Koichi Kimura, Nagoya (JP); Shinya Hirota, Susono (JP); Yoshimitsu Henda, Numazu (JP); Kazuhiro Itoh, Mishima (JP); Takamitsu Asanuma, Susono (JP); Shunsuke Toshioka, Numazu (JP); Yasuaki Nakano, Sunto-gun (JP); Koichiro Nakatani, Mishima (JP); Akira Mikami, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/620,342

(22) Filed: Jul. 17, 2003

(65) Prior Publication Data

US 2004/0020192 A1 Feb. 5, 2004

(30) Foreign Application Priority Data

Jul. 31, 2002 (JP) ..... 2002-223111

(51) Int. Cl.
*F01N 3/00* (2006.01)

(52) U.S. Cl. ..... 60/286; 60/289; 60/292; 60/295; 60/297; 60/303; 60/324

(58) Field of Classification Search ..... 60/285, 60/286, 287, 288, 289, 291, 292, 295, 297, 60/301, 303, 324
See application file for complete search history.

(56) References Cited

U.S. PATENT DOCUMENTS

| | | | | |
|---|---|---|---|---|
| 5,473,890 | A | * 12/1995 | Takeshima et al. | 60/285 |
| 6,192,675 | B1 | * 2/2001 | Hirota et al. | 60/286 |
| 6,199,372 | B1 | * 3/2001 | Wakamoto | 60/274 |
| 6,233,925 | B1 | * 5/2001 | Hirota et al. | 60/285 |
| 6,408,620 | B2 | 7/2002 | Boegner et al. | |

FOREIGN PATENT DOCUMENTS

| | | |
|---|---|---|
| DE | 199 60 430 A1 | 7/2001 |
| JP | A 5-222923 | 8/1993 |
| JP | A 6-173655 | 6/1994 |
| JP | A 7-279649 | 10/1995 |
| JP | B2 2605580 | 2/1997 |
| JP | A 2001-27114 | 1/2001 |

* cited by examiner

*Primary Examiner*—Binh Q. Tran
(74) *Attorney, Agent, or Firm*—Oliff & Berridge, PLC

(57) ABSTRACT

An exhaust emission purification device comprises a sulfur component holding agent arranged on the exhaust path of an internal combustion engine for holding a sulfur component, a $NO_x$ holding agent arranged downstream of the sulfur component holding agent in the exhaust gas for holding $NO_x$ and the sulfur components when the air-fuel ratio of the exhaust gas flowing thereinto is lean, and a reducing agent adding unit for adding a reducing agent to the exhaust gas flowing into the $NO_x$ holding agent. The concentration of the sulfur component contained in the reducing agent added by the reducing agent adding unit is lower than the concentration of at least the sulfur component contained in the fuel supplied to the combustion chamber of the internal combustion engine. Thus, the sulfur poisoning of the exhaust emission purifier can be avoided while at the same time reducing the fuel consumption rate.

19 Claims, 5 Drawing Sheets

EXHAUST EMISSION PURIFICATION DEVICE FOR INTERNAL COMBUSTION ENGINE

BACKGROUND OF THE INVENTION

1. Field of the Invention

The present invention relates to an exhaust emission purification device for an internal combustion engine.

2. Description of the Related Art

Generally, in the case where an exhaust gas flowing into an exhaust emission purifier, carrying a $NO_x$ holding agent, contains a sulfur component ($SO_x$, etc.), the exhaust emission purification capacity of the exhaust emission purifier is known to be deteriorated by sulfur poisoning.

In order to prevent the exhaust emission purification capacity of the exhaust emission purifier from being deteriorated due to sulfur poisoning, Japanese Unexamined Patent Publication No. 6-346768 discloses an exhaust emission purification device in which a sulfur component holding agent capable of holding the sulfur component in the exhaust gas flowing thereinto is arranged upstream of the exhaust emission purifier in the exhaust gas. In this exhaust emission purification device, when the sulfur component held by the sulfur component holding agent is released, the exhaust gas containing the released sulfur component is prevented from flowing into the exhaust emission purifier thereby to protect the exhaust emission purifier against the sulfur poisoning. As described above, an exhaust emission purification device having an exhaust emission purifier is required to avoid sulfur poisoning of the exhaust emission purifier.

With an exhaust emission purifier carrying a $NO_x$ holding agent, the air-fuel ratio of the exhaust gas flowing into the exhaust emission purifier is enriched by a rich spike in order to release the $NO_x$ held in the $NO_x$ holding agent. When introducing the rich spike, i.e. when enriching the air-fuel ratio of the exhaust emission gas, fuel is required. The fuel consumed for the rich spike is desirably small in amount to minimize the fuel consumption. In the exhaust emission purification device described in the publication cited above, therefore, the amount of fuel consumption for the rich spike is required to be reduced as much as possible.

In view of this situation, the object of this invention is to provide an exhaust emission purification device for reducing the amount of fuel consumption while, at the same time, avoiding sulfur poisoning of a exhaust emission purifier.

SUMMARY OF THE INVENTION

According to one aspect of the invention, there is provided an exhaust emission purification device for an internal combustion engine, comprising a sulfur component holding agent arranged on the exhaust path of the internal combustion engine for holding the sulfur component, a $NO_x$ holding agent arranged downstream of the sulfur component holding agent in the exhaust gas for holding $NO_x$ and the sulfur components when the air-fuel ratio of the exhaust gas flowing thereinto is lean, and a reducing agent adding means for adding a reducing agent to the exhaust gas flowing into the $NO_x$ holding agent, wherein the concentration of the sulfur component contained in the reducing agent added by the reducing agent adding means is lower than the concentration of at least the sulfur component contained in the fuel supplied to a combustion chamber of the internal combustion engine.

In this aspect of the invention, the provision of the sulfur component holding agent upstream of the $NO_x$ holding agent in the exhaust gas substantially eliminates the sulfur component from the exhaust gas flowing into the $NO_x$ holding agent. Also, the sulfur component contained in the reducing agent added to the exhaust gas flowing into the $NO_x$ holding agent is low in concentration. Thus, the inflow of the sulfur component into the $NO_x$ holding agent is suppressed. Further, the fuel of the required minimum amount to release $NO_x$ from the $NO_x$ holding agent can be added to the exhaust gas, thereby making it possible to suppress unnecessary fuel consumption. According to the first aspect of the invention, therefore, the amount of fuel consumption can be reduced while, at the same time, avoiding sulfur poisoning of the exhaust emission purifier.

According to another aspect of the invention, there is provided an exhaust emission purification device for an internal combustion engine, further comprising a bypass for bypassing the $NO_x$ holding agent and a flow rate regulation valve for controlling the flow rate of the exhaust gas flowing into the bypass, wherein the sulfur component holding agent holds the sulfur component in the exhaust gas flowing thereinto when the sulfur component holding conditions are satisfied, and releases the sulfur component held thereby when the sulfur component releasing conditions are satisfied, and wherein the sulfur component releasing conditions are caused to be satisfied and the greater part of the exhaust gas flows into the bypass when the sulfur component is released from the sulfur component holding agent.

In this aspect of the invention, the sulfur component holding conditions are satisfied, for example, in the case where the air-fuel ratio of the exhaust gas flowing into the sulfur component holding agent is lean or in the case where the air-fuel ratio of the exhaust gas flowing into the sulfur component holding agent is substantially equal to the stoichiometric air-fuel ratio or rich and, at the same time, the temperature of the sulfur component holding agent is lower than the sulfur component releasing temperature, while the sulfur component releasing conditions are satisfied, for example, in the case where the air-fuel ratio of the exhaust gas flowing into the sulfur component holding agent is substantially equal to the stoichiometric air-fuel ratio or rich and, at the same time, the temperature of the sulfur component holding agent is higher than the sulfur component releasing temperature.

According to still another aspect of the invention, there is provided an exhaust emission purification device for an internal combustion engine, further comprising an annular path branching from the exhaust path and returning to the branching portion and a flow rate regulation valve for controlling the flow rate of the exhaust gas flowing into the annular path and the direction in which the exhaust gas flows into the annular path, wherein the sulfur component holding agent holds the sulfur component, in the exhaust gas flowing thereinto, when the sulfur component holding conditions are satisfied and releases the sulfur component held thereby when the sulfur component releasing conditions are satisfied, wherein a $NO_x$ holding agent is arranged on the annular path and the flow regulation valve is arranged at the branching portion and wherein, when the sulfur component is released from the sulfur component holding agent, the sulfur component releasing conditions are caused to be satisfied and at the same time the flow rate regulation valve causes the greater part of the exhaust gas to flow through the exhaust path downstream of the branching portion without flowing into the annular path.

According to yet another aspect of the invention, there is provided an exhaust emission purification device for an internal combustion engine, wherein the reducing agent adding means is arranged on the annular path.

In the case where the reducing agent adding means is arranged upstream of the flow rate regulation valve in the exhaust gas, the reducing agent would be undesirably attached to the flow rate regulation valve. With the exhaust emission purification device according to this aspect of the invention, in contrast, the reducing agent adding means is arranged on the annular path and, hence, downstream of the flow rate regulation valve in the exhaust gas, thereby making it possible to avoid the problem that the reducing agent would or might be attached to the flow rate regulation valve.

According to a further aspect of the invention, there is provided an exhaust emission purification device for an internal combustion engine, wherein the greater part of the exhaust gas flows into the annular path from the exhaust path in such a manner as to flow in one direction through the annular path in the case where the flow rate regulation valve is in a first working position and, the greater part of the exhaust gas flows into the annular path from the exhaust path in such a manner as to flow in the opposite direction through the annular path in the case when the flow rate regulation valve is in a second working position.

According to a still further aspect of the invention, there is provided an exhaust emission purification device for an internal combustion engine, wherein the $NO_x$ holding agent is carried on a particulate filter capable of trapping the particulates contained in the exhaust gas flowing thereinto.

According to a yet further aspect of the invention, there is provided an exhaust emission purification device for an internal combustion engine, wherein the concentration of the sulfur component contained in the reducing agent is substantially zero.

According to a further aspect of the invention, there is provided an exhaust emission purification device for an internal combustion engine, wherein the reducing agent is light oil or methane.

According to a still further aspect of the invention, there is provided an exhaust emission purification device for an internal combustion engine, wherein the reducing agent is stored in a tank different from the tank for storing the fuel supplied to the combustion chamber of the internal combustion engine.

According to a yet further aspect of the invention, there is provided an exhaust emission purification device for an internal combustion engine, wherein the reducing agent is changed in quality from the fuel supplied to the combustion chamber of the internal combustion engine.

According to a further aspect of the invention, there is provided an exhaust emission purification device for an internal combustion engine, comprising a tank having two fuel supply paths including a fuel supply path for supplying the fuel to the combustion chamber of the internal combustion engine and a fuel supply path for supplying the fuel to the reducing agent adding means, and a desulfurizing unit for changing the quality of the fuel, arranged in the fuel supply path for supplying the fuel to the reducing agent adding means.

BRIEF DESCRIPTION OF THE DRAWINGS

The present invention may be more fully understood from the description of the preferred embodiments of the invention set forth below, together with the accompanying drawings in which.

DESCRIPTION OF THE PREFERRED EMBODIMENTS

Figure 1:
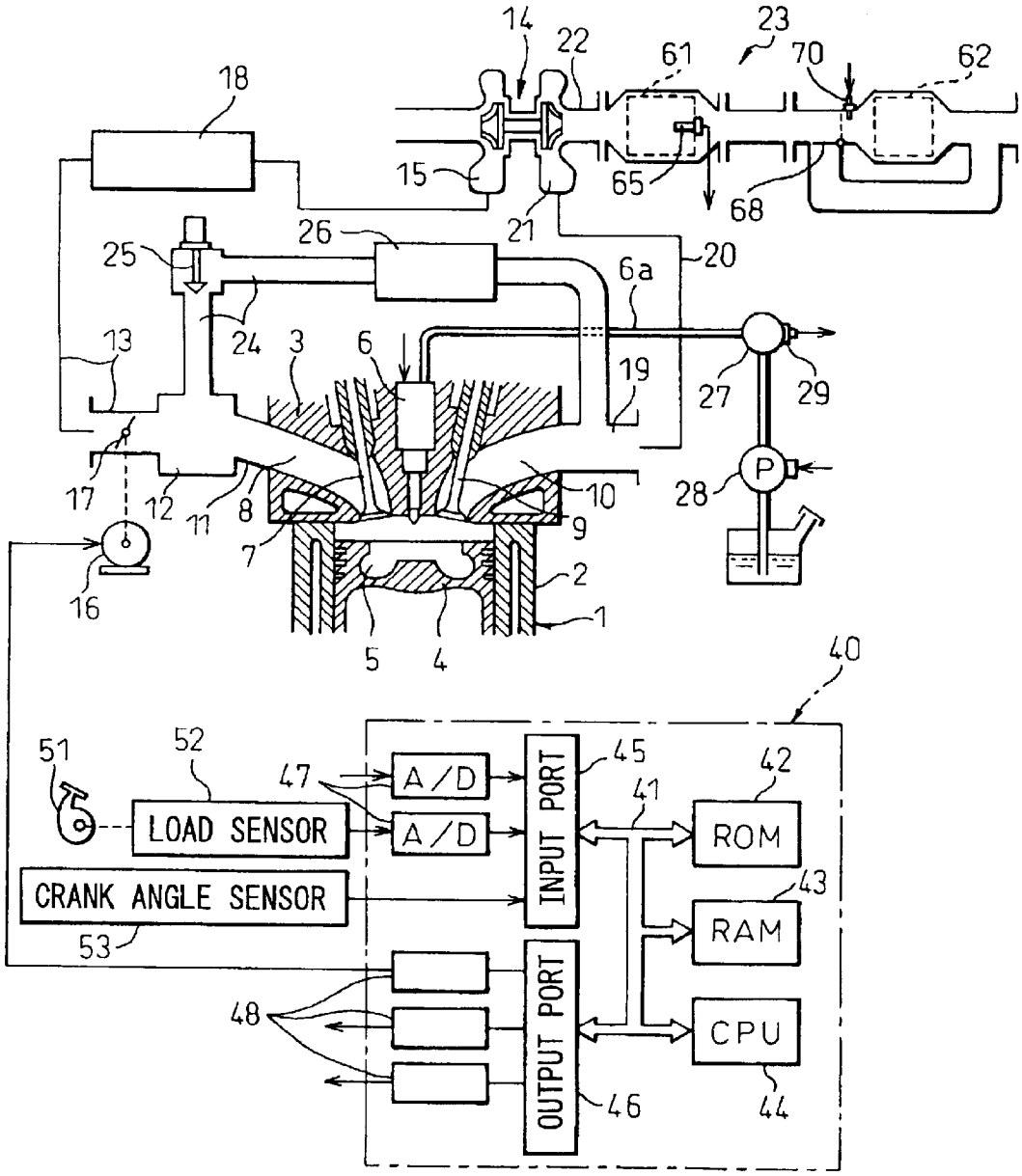
FIG. 1 is a schematic view showing the whole of an internal combustion engine comprising an exhaust emission purification device according to the invention.

An exhaust emission purification device according to the invention will be explained below with reference to the drawings. FIG. 1 shows a compression ignition diesel engine of an in-cylinder injection type having an exhaust emission purification device according to the invention. The exhaust emission purification device according to the invention is applicable also to an internal combustion engine of a spark-ignition type.

Figure 2:
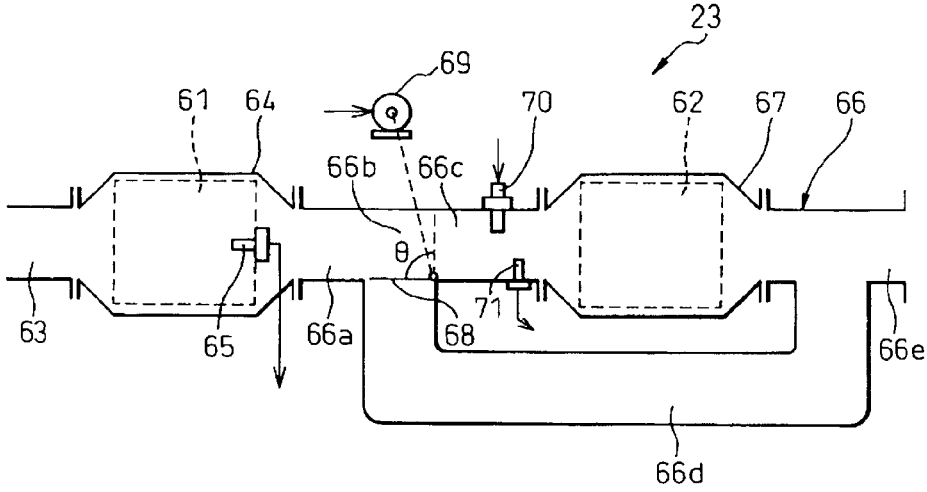
FIG. 2 is a schematic view showing an exhaust emission purification device according to a first embodiment of the invention.

Referring to FIGS. 1 and 2, reference numeral 1 designates an engine body, numeral 2 a cylinder block, numeral 3 a cylinder head, numeral 4 a piston, numeral 5 a combustion chamber, numeral 6 an electrically-controlled fuel injector, numeral 7 an intake valve, numeral 8 an intake port, numeral 9 an exhaust valve and numeral 10 an exhaust port. The intake port 8 is connected to a surge tank 12 through a corresponding intake branch pipe 11, and the surge tank 12 is connected to a compressor 15 of an exhaust turbocharger 14 through an intake duct 13.

Inside the intake duct 13 is arranged a throttle valve 17 driven by a step motor 16. Further, a cooling unit 18 is arranged around the intake duct 13 for cooling the intake air flowing in the intake duct 13. In the internal combustion engine shown in FIG. 1, the engine coolant water is led into the cooling unit 18 and the intake air is cooled by the engine coolant water. On the other hand, the exhaust port 10 is connected to an exhaust turbine 21 of the exhaust turbocharger 14 through an exhaust manifold 19 and an exhaust pipe 20, and the outlet of the exhaust turbine 21 is connected to the exhaust emission purification device 23, described in detail below, through an exhaust pipe 22.

The exhaust manifold 19 and the surge tank 12 are connected to each other through an exhaust gas recirculation (hereinafter referred to as EGR) path 24. An electrically-controlled EGR control valve 25 is arranged in the EGR path 24. An EGR cooling unit 26 is arranged around the EGR path 24 for cooling the EGR gas flowing in the EGR path 24. In the internal combustion engine shown in FIG. 1, the engine coolant water is guided into the EGR cooling unit 26 and the EGR gas is cooled.

The fuel injectors 6 are connected to a fuel reservoir, a common rail 27, through fuel supply pipes 6*a*. The fuel is supplied into the common rail 27 from an electrically-controlled variable-discharge fuel pump 28. The fuel supplied into the common rail 27 is supplied to the fuel injectors 6 through fuel supply pipes 6*a*. A fuel pressure sensor 29 is mounted on the common rail 27 for detecting the fuel pressure in the common rail 27. The discharge amount of the fuel pump 28 is controlled based on the output signal of the fuel pressure sensor 29 so that the fuel pressure in the common rail 27 reaches a target fuel pressure.

The electronic control unit (ECU) 40 includes a digital computer which, in turn, has a ROM (read-only memory) 42, a RAM (random access memory) 43, a CPU (microprocessor) 44, an input port 45 and an output port 46 connected to each other through a bidirectional bus 41. The output signal of the fuel pressure sensor 29 is input to the input port 45 through a corresponding A/D converter 47.

An accelerator pedal 51 is connected with a load sensor 52 for generating an output voltage proportional to the amount of depression of the acceleration pedal 51. The output voltage of the load sensor 52 is input to the input port 45 through a corresponding A/D converter 47. Further, the input port 45 is connected to a crank angle sensor 53 for generating an output pulse each time a crankshaft rotates by for example 30 degrees. The output port 46, on the other hand, is connected with the fuel injection valve 6, the step motor 16, the EGR control valve 25 and the fuel pump 28 through a corresponding drive circuit 48.

Next, the configuration of the exhaust emission purification device 23 according to the invention will be explained with reference to FIG. 2. The exhaust emission purification device 23 according to the invention comprises a sulfur component holding agent 61 capable of holding a sulfur component ($SO_x$, etc.) of the exhaust gas flowing thereinto and an $NO_x$ holding agent 62 capable of holding the components other than the sulfur component of the exhaust gas flowing thereinto or, especially, $NO_x$ in the exhaust gas.

The sulfur component holding agent 61 is built into a casing 64 arranged on the exhaust pipe (engine exhaust path) 63 connected to the outlet of the exhaust turbine 21. The sulfur component holding agent 61 is provided with a temperature sensor 65 for detecting the temperature of the sulfur component holding agent 61. The temperature sensor 65 is connected to the input port 45 of the ECU 40 through a corresponding A/D converter 47. An exhaust pipe 66 is arranged downstream of the exhaust pipe 63 in the exhaust gas. The exhaust pipe 66 includes an upstream exhaust pipe 66*a* a branch portion 66*b*, a holding agent-side branch pipe 66*c*, a bypass-side branch pipe (bypass) 66*d* and a downstream exhaust pipe 66*e*. The $NO_x$ holding agent 62 is built into the casing 67 arranged on the holding agent-side branch pipe 66*c*.

The exhaust pipe 66 will be described in more detail. The upstream exhaust pipe 66*a* is connected to the exhaust pipe 63 arranged upstream of the exhaust pipe 66. The upstream exhaust pipe 66*a* branches at the branching potion 66 into the holding agent-side branch pipe 66*c* and the bypass-side branch pipe 66*d* for bypassing the $NO_x$ holding agent 62. The branch pipes 66*c*, 66*d* merge with each other downstream of the $NO_x$ holding agent 62 in the exhaust gas. A flow rate regulation valve 68 is arranged at the branching portion 66*b*. The flow rate regulation valve 68 is controlled by the step motor 69 which is connected to the output port 46 of the ECU 40 through a corresponding drive circuit 48.

The flow rate regulation valve 68 is capable of regulating the flow rate of the exhaust gas flowing into the bypass-side branch pipe 66*d*. Especially, in accordance with the operating position thereof, the flow rate regulation valve 68 can regulate the ratio between the flow rate of the exhaust gas flowing into the holding agent-side branch pipe 66*c* and the flow rate of the exhaust gas flowing into the bypass-side branch pipe 66*d*. For example, the flow rate regulation valve 68 can pivot between the position for closing the bypass-side branch pipe 66*d* (the position indicated by the solid line in FIG. 2) and the bypass position for bypassing the $NO_x$ holding agent 62 by closing the holding agent-side branch pipe 66*c* (the position indicated by dashed line), and determines the flow rate of the exhaust gas flowing into each of the branch pipes 66*c*, 66*d* in accordance with the angle θ from the position at which the holding agent-side branch pipe 66*c* is closed.

The exhaust emission purification device 23 according to the first embodiment further comprises a reducing agent adding unit (reducing agent adding means) 70 arranged in the holding agent-side branch pipe 66C downstream of the flow rate regulation valve 68 upstream of the $NO_x$ holding agent 62 in the exhaust gas. The reducing agent adding unit 70 adds a reducing agent to the exhaust gas flowing into the $NO_x$ holding agent 62. More specifically, the reducing agent adding unit 70 is arranged in proximity to the $NO_x$ holding agent 62 so as to inject the reducing agent toward the $NO_x$ holding agent 62. The reducing agent adding unit 70 is connected to the output port 46 of the ECU 40 through a corresponding drive circuit 48, so that the amount of the reducing agent added to the exhaust gas is regulated based on the signal transmitted from the ECU 40. Incidentally, according to this embodiment, a fuel having a similar composition to the fuel supplied to the combustion chamber of the internal combustion engine is used as a reducing agent. Although an explanation is given on the assumption that the fuel is added to the exhaust gas from the reducing agent adding unit 70, a fuel of a composition different to the fuel supplied to the combustion chamber or any reducing agent different from the fuel may be used with equal effect.

The ratio of the air to the fuel supplied to the exhaust path upstream of the $NO_x$ holding agent 62, the combustion chamber 5 and the intake path is referred to as the air-fuel ratio of the exhaust gas. The $NO_x$ holding agent 62 of the exhaust emission purification device 23 holds the $NO_x$ in the exhaust gas when the air-fuel ratio of the exhaust gas flowing thereinto is lean, and releases the $NO_x$ held thereby when the oxygen concentration of the exhaust gas flowing thereinto decreases. Further, in the case where the oxygen concentration of the exhaust gas flowing into the $NO_x$ holding agent 62 is low and the exhaust gas flowing thereinto contains the reducing agent, the $NO_x$ released from the $NO_x$ holding agent 62 is reduced and purified.

This $NO_x$ holding agent 62 is unable to hold $NO_x$ any further when the amount of $NO_x$ held thereby increases. Specifically, in the case where the air-fuel ratio of the exhaust gas flowing into the $NO_x$ holding agent 62 continues to be lean, the $NO_x$ holding capacity of the $NO_x$ holding agent 62 decreases and then the $NO_x$ holding agent 62 is unable to hold $NO_x$ any longer, with the result that the exhaust gas that has passed through the $NO_x$ holding agent 62 still contains $NO_x$. In the case where the amount of $NO_x$ held by the $NO_x$ holding agent 62 exceeds a predetermined amount, therefore, it is a common practice to carry out the rich spike operation in which an exhaust gas having a low oxygen concentration and containing a large amount of reducing agent is introduced into the $NO_x$ holding agent 62 thereby to release and reduce the $NO_x$ held in the $NO_x$ holding agent 62.

More specifically, the $NO_x$ sensor 71 mounted upstream of the $NO_x$ holding agent 62 in the exhaust gas detects the amount of $NO_x$ in the exhaust gas flowing into the $NO_x$ holding agent 62 thereby to estimate the amount of $NO_x$ held by the $NO_x$ holding agent 62. Once the estimated amount of $NO_x$ increases beyond a predetermined amount, i.e. in the case where the $NO_x$ holding capacity of the $NO_x$ holding agent 62 decreases, the fuel is added, as a reducing agent, to the exhaust gas flowing into the $NO_x$ holding agent 62, from the reducing agent adding unit 70 mounted upstream of the $NO_x$ holding agent 62 in the exhaust gas, as a rich spike operation. The amount of the fuel added by the reducing agent adding unit 70 is sufficient to decrease the oxygen concentration of the exhaust gas flowing into the $NO_x$ holding agent 62 and to reduce the $NO_x$ released from the $NO_x$ holding agent 62 at the same time. As the result of carrying out the rich spike operation, substantially all the $NO_x$ held in the $NO_x$ holding agent 62 is released and reduced, thereby restoring the $NO_x$ holding capacity of the $NO_x$ holding agent 62.

On the other hand, the $NO_x$ holding agent 62 holds not only $NO_x$ but also the sulfur component in the exhaust gas flowing thereinto. Once the sulfur component is held in the $NO_x$ holding agent 62, the $NO_x$ holding capacity of the $NO_x$ holding agent 62 is decreased. The fact that the $NO_x$ holding capacity of the $NO_x$ holding agent 62 is decreased by the sulfur component being held by the $NO_x$ holding agent 62 is called "sulfur poisoning" of the $NO_x$ holding agent 62. More specifically, with an increase in the amount of the sulfur component held by the $NO_x$ holding agent 62, the amount of $NO_x$ which can be held by the $NO_x$ holding agent 62 decreases. In other words, with the progress of the sulfur poisoning of the $NO_x$ holding agent 62, the $NO_x$ holding ability of the $NO_x$ holding agent 62 decreases.

Generally, therefore, once the $NO_x$ holding agent 62 is sulfur-poisoned, the regeneration process of the sulfur poisoning is carried out to release the sulfur component from the $NO_x$ holding agent 62. Normally, for releasing the sulfur component held in the $NO_x$ holding agent 62, the air-fuel ratio of the exhaust gas flowing into the $NO_x$ holding agent 62 must be enriched and, at the same time, the temperature of the $NO_x$ holding agent 62 must be raised beyond the sulfur releasing temperature (say, about 650° C.).

In the diesel engine of a compression ignition type, however, the temperature of the exhaust gas flowing into the $NO_x$ holding agent 62 during the normal engine operation is much lower than the sulfur releasing temperature of the $NO_x$ holding agent 62. To carry out the regeneration process of the sulfur poisoning for the $NO_x$ holding agent 62, therefore, the internal combustion engine is required to be controlled in a special manner to increase the temperature of the exhaust gas discharged from the internal combustion engine. When the $NO_x$ holding agent 62 reaches a temperature higher than the sulfur releasing temperature, on the other hand, the $NO_x$ holding agent 62 is thermally degraded and the $NO_x$ holding capacity thereof is decreased. Also, in the case where the $NO_x$ holding agent 62 contains a catalyst substance for oxidizing the components of the exhaust gas, the performance, such as the ability to oxidize the catalyst substance, is reduced by the heat. Further, releasing the sulfur component from the $NO_x$ holding agent 62 consumes a comparatively long time and, therefore, the air-fuel ratio of the exhaust gas flowing into the $NO_x$ holding agent 62 is required to be kept rich over a comparatively long period, with the result that the fuel consumption is increased and the fuel cost is considerably increased. Also, in the case where the $NO_x$ holding agent 62 is carried on the particulate filter (hereinafter referred to as the filter), as described later, the particulates, which may trapped in the filter in a large amount, would be ignited if the temperature of the filter 62 is raised beyond the sulfur releasing temperature. As a result, the temperature of filter 62 would increase to such an extent as to melt or develop cracks in the filter.

In view of this, with the exhaust emission purification device 23 shown in FIGS. 1 and 2, a sulfur component holding agent 61 for holding the sulfur component of the exhaust gas flowing thereinto is arranged upstream of the $NO_x$ holding agent 62 in the exhaust gas so that an exhaust gas substantially free of the sulfur component flows into the $NO_x$ holding agent 62. As a result, it becomes difficult for the sulfur component to flow into the $NO_x$ holding agent 62 during the normal operation of the internal combustion engine, or especially, during other than the rich spike operation for the $NO_x$ holding agent 62. This decreases the number of times the regeneration process of the sulfur poisoning is required to be carried out for the $NO_x$ holding agent 62.

In the exhaust emission purification device 23 shown in FIGS. 1 and 2, the fuel added to the exhaust gas from the reducing agent adding unit 70 arranged upstream of the $NO_x$ holding agent 62 in the exhaust gas flows directly into the $NO_x$ holding agent 62 during the rich spike operation for releasing $NO_x$ from the $NO_x$ holding agent 62. Generally, the fuel contains a sulfur component. If the added fuel flows directly into the $NO_x$ holding agent 62, therefore, the sulfur component of the fuel comes to be held by the $NO_x$ holding agent 62, thereby undesirably promoting the sulfur poisoning of the $NO_x$ holding agent 62.

With the exhaust emission purification device 23 according to the first embodiment of the invention, in contrast, the concentration of the sulfur component contained in the fuel added from the reducing agent adding unit 70 to the exhaust gas flowing into the $NO_x$ holding agent 62 is lower than that of the sulfur component in the fuel supplied to the combustion chamber 5 of the internal combustion engine. Specifically, the reducing agent adding unit 70 adds a fuel of a low sulfur component concentration to the exhaust path upstream of the $NO_x$ holding agent 62 but downstream of the sulfur component holding agent 61 in the exhaust gas. By doing so, even in the case where the fuel is added from the reducing agent adding unit 70 such as when carrying out the rich spike operation for the $NO_x$ holding agent 62, for example, the amount of the sulfur component contained in the exhaust gas flowing into the $NO_x$ holding agent 62 is comparatively small and, therefore, the progress of the sulfur poisoning of the $NO_x$ holding agent 62 is prevented.

Especially in the case where the concentration of the sulfur component of the fuel added from the reducing agent adding unit 70 to the exhaust gas flowing into the $NO_x$ holding agent 62 is substantially zero, substantially no sulfur component flows into the $NO_x$ holding agent 62 when carrying out the rich spike operation against the $NO_x$ holding agent 62. Also, during a period other than the rich spike operation for the $NO_x$ holding agent 62, substantially all the sulfur component of the exhaust gas discharged from the internal combustion engine is removed by the sulfur component holding agent 61 and, therefore, substantially no sulfur component flows into the $NO_x$ holding agent 62. Thus, in the case where the concentration of the sulfur component of the fuel added from the reducing agent adding unit 70 is substantially zero, substantially no sulfur component flows into the $NO_x$ holding agent 62 and, therefore, the requirement for the regeneration process of the sulfur poisoning for the $NO_x$ holding agent 62 is substantially eliminated.

According to the first embodiment of the invention, the sulfur component holding agent 61 holds the sulfur component in the exhaust gas flowing thereinto when the sulfur component holding conditions are satisfied, and releases the sulfur component when the sulfur component releasing conditions are satisfied. More specifically, in the case where the air-fuel ratio of the exhaust gas flowing into the sulfur component holding agent 61 is lean or in the case where the air-fuel ratio of the exhaust gas flowing into the sulfur component holding agent 61 is substantially equal to the stoichiometric air-fuel ratio or rich with the temperature of the sulfur component holding agent 61 lower than the sulfur component releasing temperature, then the sulfur component holding agent 61 holds the sulfur component in the exhaust gas while, in the case where the air-fuel ratio of the exhaust gas flowing into the sulfur component holding agent 61 is rich and the temperature of the sulfur component holding agent 61 is higher than the sulfur component releasing temperature, on the other hand, the sulfur component holding agent 61 releases the sulfur component held thereby.

In this sulfur component holding agent 61, the amount of the sulfur component capable of being held is reduced with an increase in the amount of the sulfur component held thereby. Specifically, with the increase in the amount of the sulfur component held by the sulfur component holding agent 61, the sulfur component holding capacity of the sulfur component holding agent 61 decreases. Once the amount of the sulfur component held by the sulfur component holding agent 61 increases beyond a predetermined amount, therefore, the sulfur component releasing process is carried out for releasing the sulfur component from the sulfur component holding agent 61.

More specifically, first of all, the amount of the sulfur component of the exhaust gas flowing into the sulfur component holding agent 61 is estimated from the amount of the fuel supplied to the intake path, the combustion chamber 5 and the exhaust path upstream of the sulfur component holding agent 61, to thereby estimate the amount of the sulfur component held in the sulfur component holding agent 61. In the case where the estimated amount of the sulfur component exceeds the predetermined amount, i.e. in the case where the sulfur component holding capacity of the sulfur component holding agent 61 is reduced, the operation of the internal combustion engine is controlled in such a way as to enrich the air-fuel ratio of the exhaust gas discharged from the internal combustion engine and, at the same time, to raise the temperature of the exhaust gas discharged from the internal combustion engine. As a result, the sulfur component releasing conditions for the sulfur component holding agent 61 are satisfied, and the sulfur component is released from the sulfur component holding agent 61 thereby to restore the sulfur component holding capacity of the sulfur component holding agent 61.

When the sulfur component is released from the sulfur component holding agent 61, however, the exhaust gas flowing out downstream of the sulfur component holding agent 61 contains a greater amount of the sulfur component than the exhaust gas discharged from the internal combustion engine. In the exhaust emission purification device 23 according to the first embodiment, therefore, the sulfur component releasing process for the sulfur component holding agent 61 is carried out in such a manner that the sulfur component releasing conditions are satisfied and the working position of the flow rate regulation valve 68 is changed to the bypass position to allow the greater proportion of the exhaust gas to flow into the bypass-side branch pipe 66*d*. As a result, as long as the sulfur component releasing conditions are satisfied, substantially no exhaust gas flows into the $NO_x$ holding agent 62 and thus the exhaust gas containing a large amount of a sulfur component is prevented from flowing into the $NO_x$ holding agent 62.

As described above, the sulfur component holding agent 61 basically holds the sulfur component in the exhaust gas flowing thereinto, and when the sulfur component holding agent 61 releases the sulfur component held thereby, the exhaust gas is prevented from passing through the $NO_x$ holding agent 62. In this way, the exhaust gas containing the sulfur component can be prevented from flowing into the $NO_x$ holding agent 62, thereby making it possible to remove the sulfur component of the exhaust gas discharged from the internal combustion engine upstream of the $NO_x$ holding agent 62 in the exhaust gas.

In the case where the reducing agent adding unit for adding the fuel to the exhaust gas flowing into the $NO_x$ holding agent 62 is arranged upstream of the flow rate regulation valve 68 in the exhaust gas, the fuel is undesirably attached to the flow rate regulation valve 68. Even in the case where the fuel in an amount proper for releasing and reducing the $NO_x$ held by the $NO_x$ holding agent 62 is injected from the reducing agent adding unit in order to carry out the rich spike against the $NO_x$ holding agent 62, therefore, the amount of the fuel actually flowing into the $NO_x$ holding agent 62 is different from the proper amount described above. In other words, it becomes impossible to properly regulate the amount of the fuel flowing into the $NO_x$ holding agent 62 when injecting the fuel from the reducing agent adding unit. Also, an increased amount of the fuel attached to the flow rate regulation valve 68 would prevent from the movement of the flow rate regulation valve 68, thereby making it impossible to control the flow rate regulation valve 68. Further, if the reducing agent adding unit is arranged upstream of the flow regulation valve 68 in the exhaust gas, the distance from the reducing agent adding unit to the $NO_x$ holding agent 62 is generally lengthened, and the fuel is attached to the portion of the exhaust pipe ranging from the reducing agent adding unit to the $NO_x$ holding agent 62. This also makes it impossible to properly regulate the amount of the fuel flowing into the $NO_x$ holding agent 62 when injecting the fuel from the reducing agent adding unit.

In the exhaust emission purification device 23 according to the first embodiment of the invention, in contrast, as shown in FIG. 2, the reducing agent adding unit 70 is arranged downstream of the flow rate regulation valve 68 and upstream of the $NO_x$ holding agent 62 in the exhaust gas. Thus, the fuel, when injected from the reducing agent adding unit 70, is prevented from attaching to the flow rate regulation valve 68. As a result, the amount of the fuel flowing into the $NO_x$ holding agent 62, after being injected by the reducing agent adding unit 70, can be properly regulated, while at the same time the flow rate regulation valve 68 is not prevented from moving. Also, by arranging the reducing agent adding unit 70 immediately upstream of the $NO_x$ holding agent 62 or setting the injection from the reducing agent adding unit 70 in the direction toward the $NO_x$ holding agent 62, the amount of the fuel flowing into the $NO_x$ holding agent 62, after being injected from the reducing agent adding unit 70, can be regulated properly.

Figure 3A:
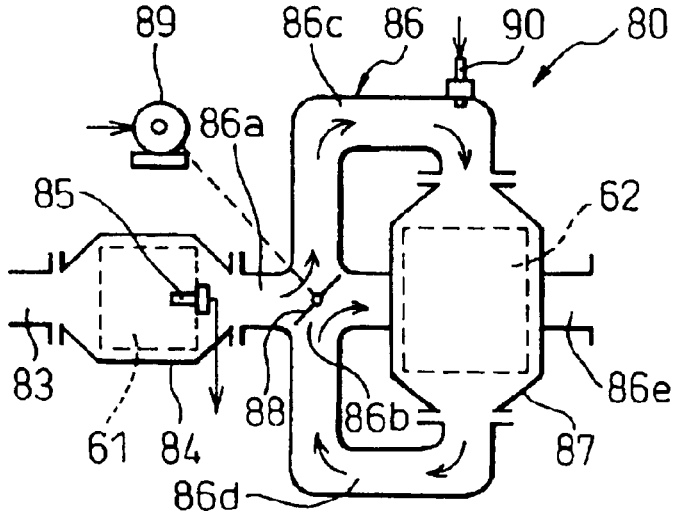
FIGS. 3A–3C are a schematic views showing an exhaust emission purification device according to a second embodiment of the invention.
Figure 3B:
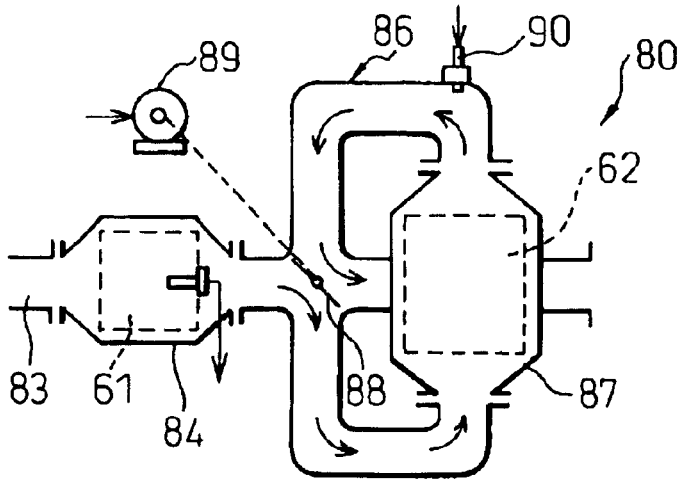
Figure 3C:
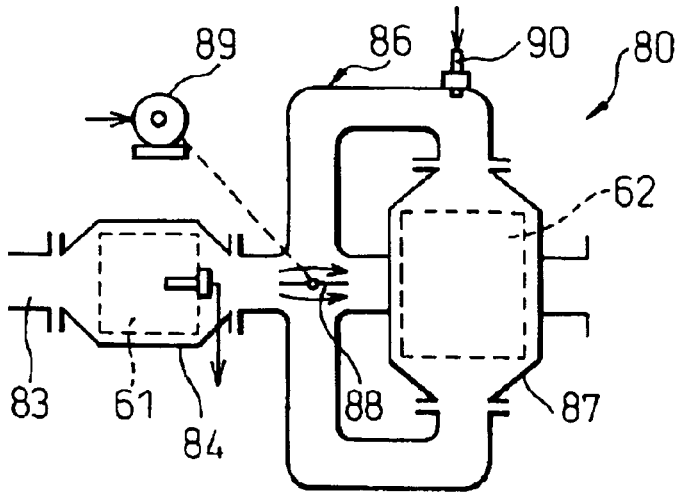

Next, an exhaust emission purification device 80 according to a second embodiment of the invention will be explained with reference to FIGS. 3A–3C. The exhaust emission purification device 80 according to the second embodiment has a configuration similar to the exhaust emission purification device 23 according to the first embodiment, except that the configuration of the exhaust pipe 86 is different from that of the exhaust pipe 66 according to the first embodiment. FIGS. 3A–3C are schematic views similar to FIG. 2. FIG. 3A shows the flow rate regulation valve 88 in the first working position, FIG. 3B the flow rate regulation valve 88 in the second working position, and FIG. 3C the flow rate regulation valve 88 in at the intermediate working position. In these views, the arrows indicate the flow of the exhaust gas.

As shown in FIGS. 3A–3C, according to the second embodiment, the exhaust pipe 86 includes trunk exhaust pipes 86*a*, 86*e*, and annular branch pipes (annular paths) 86*c*, 86*d* connected to the trunk exhaust pipes 86*a*, 86*e*. A casing 87 having the $NO_x$ holding agent 62 built therein is arranged on the annular branch pipes 86*c*, 86*d*. A branching portion 86*b* is arranged at the junction point between the trunk exhaust pipes 86*a*, 86*e* and the annular branch pipes 86*c*, 86*d*. Specifically, the annular branch pipes 86*c*, 86*d* branch from the branching portion 86*b* of the trunk exhaust pipes 86*a*, 86*e* and return to the branching portion 86*b*. The annular branch pipes 86*c*, 86*d* contain the reducing agent adding unit 90.

More specifically, the trunk exhaust pipes include the upstream partial exhaust pipe 86*a* upstream of the branching portion 86*b* in the exhaust gas and the downstream partial exhaust pipe 86*e* downstream of the branching portion 86*b* in the exhaust gas. The annular branch pipes include a first partial annular branch pipe 86*c* for connecting the branching portion 86*b* to one side of the $NO_x$ holding agent 62 and a second partial branch pipe 86*d* for connecting the branching portion 86*b* to the other side of the $NO_x$ holding agent 62. The upstream partial exhaust pipe 86*a* branches at the branching portion 86*b* into three exhaust pipes including the first partial annular branch pipe 86*c*, the second partial annular branch pipe 86*d* and the downstream partial exhaust pipe 86*e*. The upstream partial exhaust pipe 86*a* and the downstream partial exhaust pipe 86*e* are substantially aligned with each other, while the first partial annular branch pipe 86*c* and the second partial annular branch pipe 86*d* branch off in opposite directions and substantially perpendicular to the trunk exhaust pipe 86*a*, 86*e*. Also, the reducing agent adding unit 90 is arranged in the first partial annular branch pipe 86*c*, in such a manner as to inject the fuel toward the $NO_x$ holding agent 62 in the exhaust gas flowing into the $NO_x$ holding agent 62 from the first partial annular branch pipe 86*c*.

The flow rate regulation valve 88 is arranged at the branching portion 86*b*. The operation of the flow rate regulation valve 88 is controlled by the step motor 89 connected to the output port 46 of the ECU 40 through the corresponding drive circuit 48. The flow rate regulation valve 88 is rotated continuously about the center of the branching portion 86*b*, and the angle θ thereof changes with respect to the axial line of the trunk exhaust pipes 86*a*, 86*e*. Thus, it is possible to control the flow rate of the exhaust gas flowing into the annular branch pipes 86*c*, 86*d* and the direction in which the exhaust gas flows into the annular branch pipes 86*c*, 86*d*.

Especially, the flow rate regulation valve 88 according to the second embodiment is rotated roughly between three working positions of different angles. The three positions include the first working position shown in FIG. 3A, the second working position shown in FIG. 3B and the intermediate working position shown in FIG. 3C. In the case where the flow rate regulation valve 88 is in the first working position shown in FIG. 3A, substantially all the exhaust gas flowing into the branching portion 86*b* from the upstream partial exhaust pipe 86*a* flows into the first partial annular branch pipe 86*c*, and through the $NO_x$ holding agent 62 in one direction and then into the second partial annular branch pipe 86*d*, and returns again to the branching portion 86*b*. All the exhaust gas that has returned to the branching portion 86*b* from the second partial annular branch pipe 86*d* flows out to the downstream partial exhaust pipe 86*e*. In the description that follows, the explanation assumes that the direction in which the exhaust gas flows through the annular branch pipes 86*c*, 86*d* and the $NO_x$ holding agent 62 in the way as described above is the forward direction.

In the case where the flow rate regulation valve 88 is in the second working position shown in FIG. 3B, on the other hand, substantially all the exhaust gas flowing into the branching portion 86*b* from the upstream exhaust pipe 86*a* flows into the second partial branch pipe 86*d*, and through the $NO_x$ holding agent 86 in the opposite direction to the direction in which the exhaust gas flows when the flow regulation valve 88 is located at the first working position, and then into the first partial annular branch pipe 86*c*, and returns again to the branching portion 86*b*. All the exhaust gas that has returned to the branching portion 86*b* from the first partial annular branch pipe 86*c* flows out to the downstream exhaust pipe 86*e*. In the description that follows, the explanation assumes that the direction in which the exhaust gas flows through the annular branch pipes 86*c*, 86*d* and the $NO_x$ holding agent 62 in this way as described above is the opposite direction.

Specifically, as described above, depending on the working position of the flow rate regulation valve 88, the exhaust gas that has flowed into the branching portion 86*b* from the upstream exhaust pipe 86*a* can flow in one or opposite direction through the annular branch pipes 86*c*, 86*d* having the $NO_x$ holding agent 62, and then can flow out to the downstream exhaust pipe 86*e* through the branching portion 86*b*.

As described above, according to the second embodiment, the flow of the exhaust gas passing through the $NO_x$ holding agent 62 can be changed between the forward direction and the opposite direction. Therefore, the imbalance of the $NO_x$ amount held depending on the positions by the $NO_x$ holding agent 62 can be relaxed and the $NO_x$ holding agent can be efficiently utilized. Also, in the case where the $NO_x$ holding agent is carried in the filter as described later, the exhaust emission purification device according to the second embodiment can efficiently utilize the filter 62 by relaxing the imbalance in the amount of the trapped particulates depending on the positions in the filter. Further, by changing the direction of flow of the exhaust gas, the filter is prevented from clogging.

In the case where the flow rate regulation valve 88 is in the intermediate working position shown in FIG. 3C, substantially all the exhaust gas that has flowed into the branching portion 86*b* from the upstream exhaust pipe 86*a* flows into the downstream exhaust pipe 86*e* but not into the annular branch pipes 86*c*, 86*d*. Specifically, in the case where the flow rate regulation valve 88 is in the intermediate working position, the exhaust gas flows out to the downstream exhaust pipe 86*e* without passing through the $NO_x$ holding agent 62. According to the second embodiment, therefore, the intermediate working position of the flow rate regulation valve 88 constitutes a bypass position for bypassing the $NO_x$ holding agent 62 like the bypass position of the flow rate regulation valve 68 in the preceding embodiment. With the exhaust emission purification device 80 according to the second embodiment, the sulfur component is released from the sulfur component holding agent 61 by satisfying the sulfur component releasing conditions while, at the same time, regulating the flow rate regulation valve 88 in such a manner that the greater part of the exhaust gas flows through the exhaust path downstream of the branching portion 86*b* without flowing into the annular paths 86*c*, 86*d*.

Also, in the exhaust emission purification device 80 according to the second embodiment, the reducing agent adding unit 90 is arranged in the first partial annular branch pipe 86*c*. In the case where the exhaust gas flows in the forward direction through the $NO_x$ holding agent 62 and the annular branch pipes 86*c*, 86*d*, therefore, the exhaust gas with the fuel added thereto by the reducing agent adding unit 90 flows into the $NO_x$ holding agent 62. In the case where the fuel flows in the opposite direction, however, the exhaust gas, even having the fuel added thereto from the reducing agent adding unit 90, is discharged without passing through the $NO_x$ holding agent 62. In the case where the rich spike operation is carried out for the $NO_x$ holding agent 62 in the exhaust emission purification device 80 according to the second embodiment, therefore, the flow rate regulation valve 88 is set at the first working position to assure the forward flow of the exhaust gas. Specifically, in the case where a single reducing agent adding unit 90 is arranged in the annular branch pipes 86*c*, 86*d*, the rich spike operation, if any, is carried out for the $NO_x$ holding agent 62 by adjusting the working position of the flow rate regulation valve 88 in such a manner that the fuel is added to the exhaust gas from the reducing agent adding unit 90 upstream of the $NO_x$ holding agent 62.

In the exhaust emission purification device 80 according to the second embodiment described above, a single reducing agent adding unit 90 is arranged in the annular branch pipes 86*c*, 86*d*. Alternatively, however, a single reducing agent adding unit may be arranged for each of the annular branch pipes 86*c*, 86*d* on both sides of the $NO_x$ holding agent 62, i.e. for each of the first partial annular branch pipe 86*c* and the second partial annular branch pipe 86*d*. As another alternative, a reducing agent adding unit may be arranged upstream of the flow rate regulation valve 88 in the exhaust gas. As a result, regardless of whether the exhaust gas flows in forward or opposite direction through the annular branch pipes 86*c*, 86*d* and the $NO_x$ holding agent 62, the rich spike operation can be carried out for the $NO_x$ holding agent 62 as long as the flow rate regulation valve 88 is located at a working position other than the bypass position.

Figure 4:
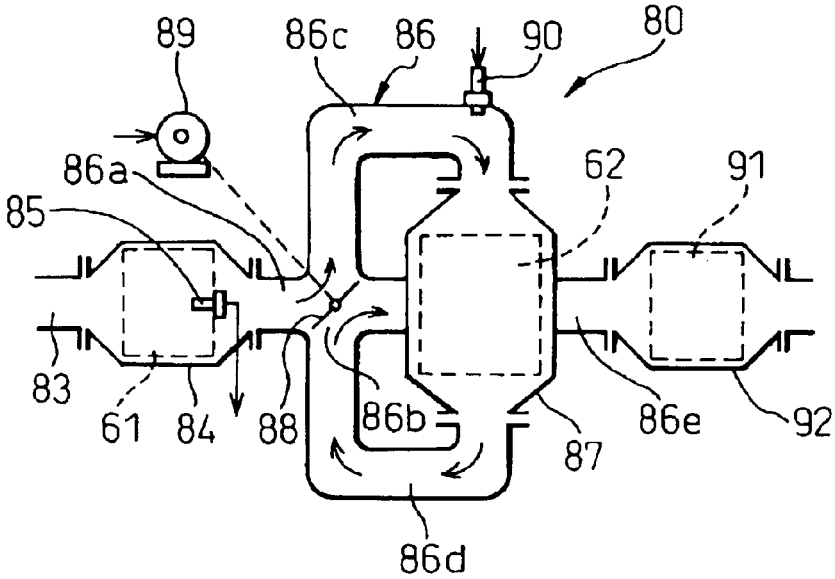
FIG. 4 is a schematic view showing an exhaust emission purification device according to a third embodiment of the invention.

Next, the exhaust emission purification device according to a third embodiment of the invention will be explained with reference to FIG. 4. FIG. 4 is a schematic view similar to FIG. 3A showing the exhaust emission purification device 80 according to the second embodiment. As shown in FIG. 4, the exhaust emission purification device according to the third embodiment comprises a purification catalyst 91 built in the casing 92 downstream of the exhaust emission purification device 80 according to the second embodiment in the exhaust gas. The purification catalyst 91 is capable of purifying the exhaust gas flowing thereinto and arranged downstream of the downstream exhaust pipe 86*e* in the exhaust gas.

According to the second embodiment described above, in the case where the working position of the flow rate regulation valve 88 is changed to the bypass position in order to release the sulfur component from the sulfur component holding agent 61, substantially all the exhaust gas fails to pass through the $NO_x$ holding agent 62 and therefore is discharged into the atmosphere without being purified thereby deteriorating the exhaust emission.

According to the third embodiment of the invention, in contrast, the purification catalyst 91 is arranged downstream of the downstream exhaust pipe 86*e* in the exhaust gas. In the case where the sulfur component releasing process is performed for the sulfur component holding agent 61, therefore, the exhaust gas not substantially purified flows into the purification catalyst 91, which purifies the components other than the sulfur component of the exhaust gas. Even in the case where the $NO_x$ holding agent 62 is bypassed, to release the sulfur component from the sulfur component holding agent 61, therefore, the not-substantially-purified exhaust gas is prevented from being discharged into the atmosphere.

The purification catalyst 91 may be either a three-way catalyst not easily capable of holding the sulfur component of the influent exhaust gas or a particulate filter capable of trapping the particulates contained in the exhaust gas. Also, the exhaust emission purification device according to the third embodiment may be combined with the exhaust emission purification device according to the first embodiment. In this case, the purification catalyst 91 is arranged downstream of the confluence between the holding agent-side branch pipe 66*c* and the bypass-side branch pipe 66*d*.

Figure 5:
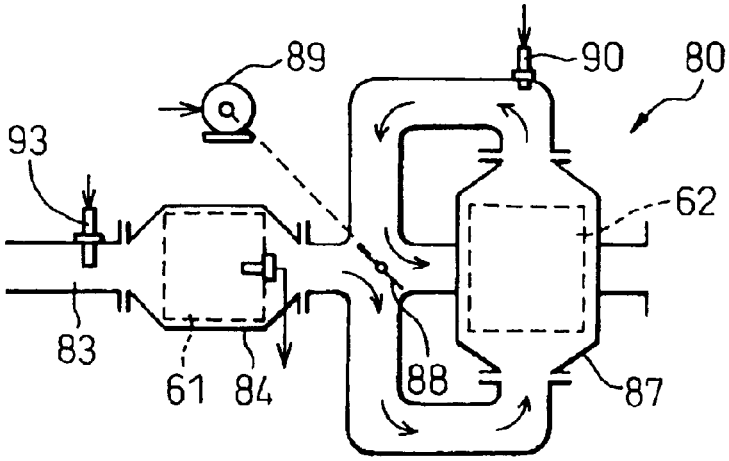
FIG. 5 is a schematic view showing an exhaust emission purification device according to a fourth embodiment of the invention.

Next, an exhaust emission purification device according to a fourth embodiment of the invention will be explained with reference to FIG. 5. FIG. 5 is a schematic view similar to FIGS. 3A–3C and 4. The exhaust emission purification device according to the fourth embodiment comprises a reducing agent adding unit 93 in addition to the reducing agent adding unit 90 arranged in the annular branch pipes 86*c*, 86*d* upstream of the sulfur component holding agent 61 in the exhaust gas in the exhaust emission purification device according to the second embodiment.

With the exhaust emission purification device according to the fourth embodiment, in the case where the sulfur component held by the sulfur component holding agent 61 is required to be released, i.e. in the case where the sulfur component held by the sulfur component holding agent 61 exceeds a predetermined amount, the fuel is injected from the additional reducing agent adding unit 93 for releasing the sulfur component held by the sulfur component holding agent 61. The amount of the fuel injected into the exhaust gas from the additional reducing agent adding unit 93 is sufficient both to enrich the air-fuel ratio of the exhaust gas flowing into the sulfur component holding agent 61 and also to increase the temperature of the sulfur component holding agent 61 to higher than the sulfur component releasing temperature by burning the injected fuel.

The exhaust emission purification device according to the fourth embodiment may be combined with the exhaust emission purification device according to the first embodiment and/or the third embodiment. In this case, the additional reducing agent adding unit is arranged upstream of the exhaust emission purification device according to the first and/or third embodiment in the exhaust gas.

In the embodiments described above, the fuel to be injected from the reducing agent adding units 70, 90, 93 is stored in a fuel tank (an additional fuel tank, not shown) different from the tank for the fuel supplied to the combustion chamber 5 of the internal combustion engine. As a result, the fuels from the two tanks are not mixed before being supplied to the combustion chamber 5 of the internal combustion engine or before being injected from the reducing agent adding unit 70, 90, 93. A fuel lower in sulfur component concentration than the fuel supplied to the internal combustion engine is stored in the additional fuel tank for the fuel to be injected from the reducing agent adding units 70, 90, 93, respectively.

As an alternative, in the embodiments described above, the fuel to be injected from the reducing agent adding unit 70, 90, 93 is changed in quality from the fuel supplied to the combustion chamber 5 of the internal combustion engine. Specifically, the fuel to be injected from the reducing agent adding unit 70, 90, 93 is generated by desulfurizing the fuel supplied to the combustion chamber 5 of the internal combustion engine. The fuel may be desulfurized either before or after the fuel is supplied to the fuel tank. In the case where the fuel is desulfurized before being supplied to the fuel tank, the desulfurized fuel is stored in the additional fuel tank.

In the case where the fuel is desulfurized after being supplied to the fuel tank, on the other hand, the internal combustion engine is equipped with a desulfurizing unit for desulfurizing the fuel. In this case, there is provided only one fuel tank from which two fuel supply paths are formed including a fuel supply path for supplying the fuel to the combustion chamber of the internal combustion engine and a fuel supply path for supplying the fuel to the reducing agent adding unit. The desulfurizing unit is arranged in the fuel supply path for supplying the fuel to the reducing agent adding unit.

Actually, however, any fuel can be used for injection from the reducing agent adding unit as far as the oxygen concentration of the exhaust gas flowing into the $NO_x$ holding agent 62 can be decreased and the $NO_x$ released from the $NO_x$ holding agent can be reduced. Light oil, methane, etc. are some examples of the fuel.

In the embodiments described above, the $NO_x$ holding agent 62 may be carried on the particulate filter capable of trapping the particulates in the exhaust gas flowing thereinto. Further, this particulate filter may include an active oxygen generating agent for continuously oxidizing and removing the trapped particulates, in the mechanism described later. The active oxygen generating agent, like the $NO_x$ holding agent 62 in the embodiments described above, can hold and release the sulfur component of the exhaust gas flowing thereinto. The ability of the active oxygen generating agent to remove the particulates is reduced by holding the sulfur component.

Figure 6A:
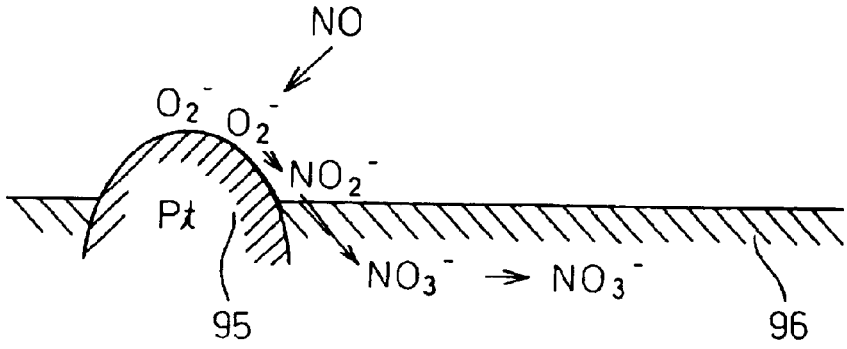
FIGS. 6A and 6B are a views for explaining the operation of removing the fine particles.
Figure 6B:
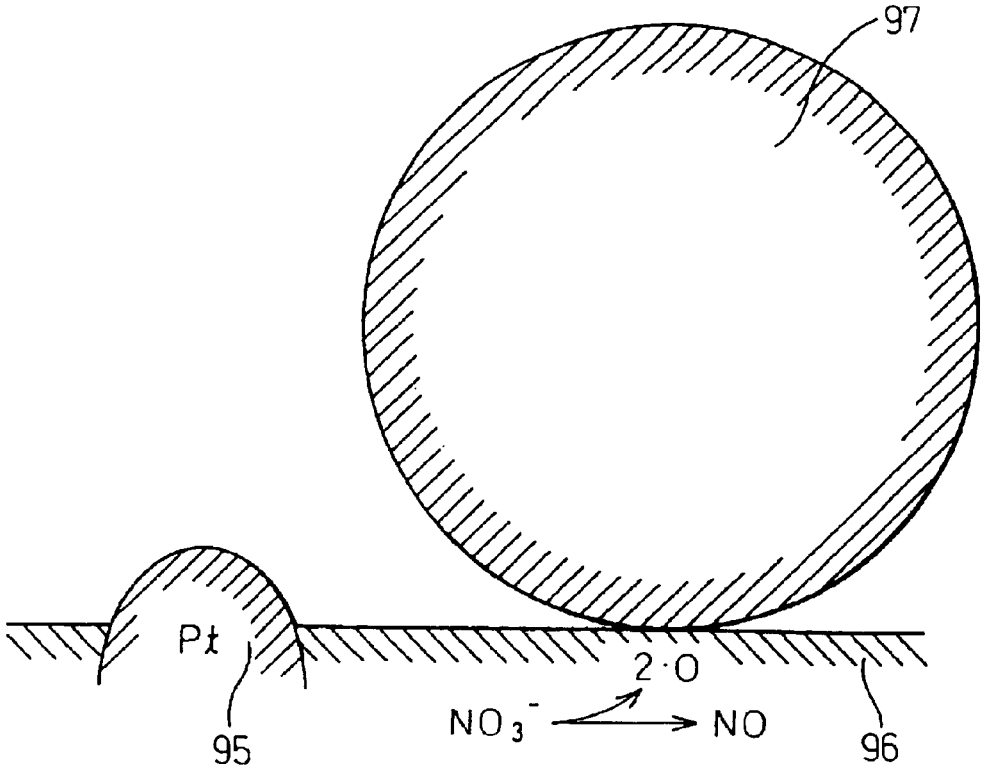

A mechanism for purifying the exhaust gas by the particulate filter (hereinafter referred to as the filter) or especially, the action thereof for removing the particulates from the exhaust gas according to this invention will be explained below. In FIGS. 6A and 6B, an explanation will be given about a case in which platinum (Pt) is used as a precious metal catalyst and potassium (K) as an active oxygen producing agent. A similar action of removing the particulates can be performed even when using another precious metals, alkali metals, alkali earth metals, rare earth or transition metals.

FIGS. 6A and 6B are enlarged views schematically showing the surface of a carrier layer formed on the surface of a filter partition wall and the microporous surface of the partition wall. In FIGS. 6A and 6B, numeral 95 designates platinum particles, and numeral 96 a carrier layer containing an active oxygen producing agent such as potassium.

In the case where the air-fuel ratio of the exhaust gas flowing into the filter is lean, $NO_x$, or especially NO and $NO_2$ is produced in the combustion chamber 5. Therefore, the exhaust gas contains $NO_x$. In this way, the exhaust gas containing an excess oxygen and $NO_x$ flows into the filter.

Once the exhaust gas flows into the filter, as shown in FIG. 6A, the oxygen in the exhaust gas adheres to the surface of platinum in the form of $O_2^-$ or $O^{2-}$. The NO in the exhaust gas, on the other hand, reacts with $O_2^-$ or $O^{2-}$ on the surface of the platinum and becomes $NO_2$ ($2NO+O_2 \rightarrow 2NO_2$). Then, part of the $NO_2$ in the exhaust gas and the $NO_2$ thus produced are absorbed in the active oxygen producing agent 96 while being oxidized on the platinum, and, while bonding with the potassium, diffuses in the active oxygen producing agent 96 in the form of nitrate ions ($NO_3^-$) as shown in FIGS. 6A and 6B to thereby generate a nitrate ($KNO_3$). In other words, the oxygen in the exhaust gas is held in the active oxygen producing agent 96 in the form of nitrogen ions.

Particulates mainly composed of carbon (C) are produced in the combustion chamber. Thus, the exhaust gas contains these particulates. The particulates in the exhaust gas, while flowing in the filter, come into contact with and adhere to the surface of the active oxygen producing agent 96 as shown in FIG. 6B.

Once the particulates 97 are adhered to the active oxygen producing agent 96, a concentration difference develops between the surface of the active oxygen producing agent 96 and the interior thereof. The active oxygen producing agent 96 has held therein oxygen in the form of nitrate ions, and this held oxygen tends to move toward the contact surface between the particulates 97 and the active oxygen producing agent 96. As a result, the nitrate ($KNO_3$) formed in the active oxygen producing agent 96 is decomposed into O and NO, of which O moves toward the surface of the active oxygen producing agent 96 while NO is released out from the active oxygen producing agent 96. The NO released out in this way is oxidized on the downstream platinum by the mechanism described above, and held again as nitrate ions in the active oxygen producing agent 96.

The oxygen O moving toward the contact surface between the particulate 97 and the active oxygen producing agent 96, which is oxygen formed by decomposition from a chemical compound such as a nitrate ($KNO_3$), has unpaired electrons and constitutes active oxygen having a very high reactivity. Once this active oxygen is brought into contact with the particulates 97, the particulates 97 are oxidized in a short time (several seconds to scores of minutes) and completely removed without generating a luminous flame. In this way, the particulates 97 are oxidized away and rarely accumulate on the filter.

In this specification, the term "hold" is to be understood to mean either "absorb" or "adsorb". The term "$NO_x$ holding agent", therefore, means both "$NO_x$ absorbent" and "$NO_x$ adsorbent". The former accumulates $NO_x$ in the form of nitrate or the like, and the latter adsorbs $NO_x$ in the form of $NO_2$ or the like. Also, the term "release" from the $NO_x$ holding agent is to be understood to mean "discharge" as an antonym of "absorb", or "release" as an antonym of "adsorb".

While the invention has been described by reference to specific embodiments chosen for purposes of illustration, it should be apparent that numerous modifications could be made thereto by those skilled in the art without departing from the basic concept and scope of the invention.

What is claimed is:

1. An exhaust emission purification device for an internal combustion engine, comprising:

a sulfur component holding agent arranged in the exhaust path of the internal combustion engine for holding a sulfur component;

a $NO_x$ holding agent arranged downstream of said sulfur component holding agent in the exhaust gas for holding $NO_x$ and the sulfur components when the air-fuel ratio of the exhaust gas flowing thereinto is lean; and reducing agent adding means disposed between said sulfur component holding agent and said $NO_x$ holding agent, said reducing agent adding means for adding a reducing agent to the exhaust gas flowing into said $NO_x$ holding agent;

wherein the concentration of the sulfur component in the reducing agent added by said reducing agent adding means is lower than the concentration of the sulfur component in the fuel supplied to a combustion chamber of the internal combustion engine.

2. An exhaust emission purification device for an internal combustion engine as set forth in claim 1, further comprising a bypass for bypassing said $NO_x$ holding agent and a flow rate regulation valve for controlling the flow rate of the exhaust gas flowing into said bypass, wherein said sulfur component holding agent holds the sulfur component in the exhaust gas flowing thereinto in the case where the sulfur component holding conditions are satisfied, and releases said sulfur component held thereby in the case where the sulfur component releasing conditions are satisfied, and wherein the sulfur releasing conditions are caused to be satisfied and the greater part of the exhaust gas flows into said bypass in the case where the sulfur component is released from said sulfur component holding agent.

3. An exhaust emission purification device for an internal combustion engine, comprising:

a sulfur component holding agent arranged in the exhaust path of the internal combustion engine for holding a sulfur component;

a $NO_x$ holding agent arranged downstream of said sulfur component holding agent in the exhaust gas for holding $NO_x$ and the sulfur components when the air-fuel ratio of the exhaust gas flowing thereinto is lean;

a reducing agent adding means for adding a reducing agent to exhaust gas flowing into said $NO_x$ holding agent; and an annular path branching from said exhaust path and returning to said branching portion, and a flow rate regulation valve for controlling the flow rate of the exhaust gas flowing into said annular path and the direction in which the exhaust gas flows into said annular path, wherein the concentration of the sulfur component in the reducing agent added by said reducing agent adding means is lower than the concentration of the sulfur component in the fuel supplied to a combustion chamber of the internal combustion engine, said sulfur component holding agent holds the sulfur component in the exhaust gas flowing thereinto in the case where the sulfur component holding conditions are satisfied, and releases said sulfur component held thereby in the case where the sulfur component releasing conditions are satisfied, said $NO_x$ holding agent is arranged on said annular path, said flow rate regulation valve is arranged at said branching portion, and, when the sulfur component is released from said sulfur component holding agent, the sulfur releasing conditions are caused to be satisfied and said flow rate regulation valve causes the greater part of the exhaust gas to flow through the exhaust path downstream of said branching portion without flowing into said annular path.

4. An exhaust emission purification device for an internal combustion engine as set forth in claim 3, wherein said reducing agent adding means is arranged on said annular path.

5. An exhaust emission purification device for an internal combustion engine as set forth in claim 3, wherein the greater part of the exhaust gas flows into the annular path from the exhaust path in such a manner as to flow in one direction through said annular path in the case where said flow rate regulation valve is in a first working position, and while the greater part of the exhaust gas flows into the annular path from the exhaust path in such a manner as to flow in the opposite direction through said annular path in the case where said flow rate regulation valve is in a second working position.

6. An exhaust emission purification device for an internal combustion engine as set forth in claim 1, wherein said $NO_x$ holding agent is carried on a particulate filter capable of trapping particulates contained in the exhaust gas flowing thereinto.

7. An exhaust emission purification device for an internal combustion engine as set forth in claim 1, wherein the concentration of the sulfur component in said reducing agent is substantially zero.

8. An exhaust emission purification device for an internal combustion engine as set forth in claim 1, wherein said reducing agent is selected one of light oil and methane.

9. An exhaust emission purification device for an internal combustion engine as set forth in claim 1, wherein said reducing agent is stored in a tank different from the tank for storing the fuel supplied to the combustion chamber of the internal combustion engine.

10. An exhaust emission purification device for an internal combustion engine as set forth in claim 1, wherein said reducing agent is changed in quality from the fuel supplied to the combustion chamber of the internal combustion engine.

11. An exhaust emission purification device for an internal combustion engine as set forth in claim 10, further comprising:

a tank having two fuel supply paths including a fuel supply path for supplying the fuel to the combustion chamber of the internal combustion engine and a fuel supply path for supplying the fuel to said reducing agent adding means, and a desulfurizing unit, for changing the quality of the fuel, arranged in the fuel supply path for supplying the fuel to said reducing agent adding means.

12. An exhaust emission purification device for an internal combustion engine, comprising:

a sulfur component holding agent arranged in the exhaust path of the internal combustion engine for holding a sulfur component when an air-fuel ratio is lean or substantially stoichiometric or rich with a temperature of the sulfur component holding agent being below a sulfur component releasing temperature, and for releasing the sulfur component when the air-fuel ratio of the exhaust gas is rich and the temperature exceeds the releasing temperature;

a $NO_x$ holding agent arranged downstream of said sulfur component holding agent in the exhaust gas for holding $NO_x$ and the sulfur components when the air-fuel ratio of the exhaust gas flowing thereinto is lean;

a flow rate regulation valve for controlling a portion of the exhaust gas to bypass the $NO_x$ holding agent through a bypass; and reducing agent adding means for adding a reducing agent to the exhaust gas flowing into said $NO_x$ holding agent, the reducing agent adding means arranged between the flow rate regulation valve and the $NO_x$ holding agent, wherein the concentration of the sulfur component in the reducing agent added by said reducing agent adding means is lower than the concentration of the sulfur component in the fuel supplied to a combustion chamber of the internal combustion engine.

13. An exhaust emission purification device for an internal combustion engine as set forth in claim 12, wherein said sulfur component holding agent holds the sulfur component in the exhaust gas flowing thereinto in the case where the sulfur component holding conditions are satisfied, and releases said sulfur component held thereby in the case where the sulfur component releasing conditions are satisfied, and wherein the sulfur releasing conditions are caused to be satisfied and the greater part of the exhaust gas flows into said bypass in the case where the sulfur component is released from said sulfur component holding agent.

14. An exhaust emission purification device for an internal combustion engine as set forth in claim 12, wherein said $NO_x$ holding agent is carried on a particulate filter capable of trapping particulates contained in the exhaust gas flowing thereinto.

15. An exhaust emission purification device for an internal combustion engine as set forth in claim 12, wherein the concentration of the sulfur component in said reducing agent is substantially zero.

16. An exhaust emission purification device for an internal combustion engine as set forth in claim 12, wherein said reducing agent is selected one of light oil and methane.

17. An exhaust emission purification device for an internal combustion engine as set forth in claim 12, wherein said reducing agent is stored in a tank different from the tank for storing the fuel supplied to the combustion chamber of the internal combustion engine.

18. An exhaust emission purification device for an internal combustion engine as set forth in claim 12, wherein said reducing agent is changed in quality from the fuel supplied to the combustion chamber of the internal combustion engine.

19. An exhaust emission purification device for an internal combustion engine as set forth in claim 18, further comprising:

a tank having two fuel supply paths including a fuel supply path for supplying the fuel to the combustion chamber of the internal combustion engine and a fuel supply path for supplying the fuel to said reducing agent adding means, and a desulfurizing unit, for changing the quality of the fuel, arranged in the fuel supply path for supplying the fuel to said reducing agent adding means.

* * * * *